US007530191B2

(12) United States Patent
Szabo

(10) Patent No.: US 7,530,191 B2
(45) Date of Patent: May 12, 2009

(54) SEMI-AUTOMATIC HANDGUN, MAGAZINE, AND FOLLOWER

(75) Inventor: Atilla Szabo, Toronto (CA)

(73) Assignee: Athanasios Polyzos, Toronto, Ontario (CA)

( * ) Notice: Subject to any disclaimer, the term of this patent is extended or adjusted under 35 U.S.C. 154(b) by 356 days.

(21) Appl. No.: 11/109,934

(22) Filed: Apr. 20, 2005

(65) Prior Publication Data

US 2006/0236580 A1 Oct. 26, 2006

(51) Int. Cl.
*F41A 9/61* (2006.01)

(52) U.S. Cl. ..... 42/50; 42/49.01

(58) Field of Classification Search ..... 42/49.01, 42/50

See application file for complete search history.

(56) References Cited

U.S. PATENT DOCUMENTS

| | | | | | |
|---|---|---|---|---|---|
| 708,794 | A * | 9/1902 | Browning | 89/138 |
| 984,519 | A | 2/1911 | Browning | |
| 2,441,735 | A * | 5/1948 | Warner | 42/50 |
| 3,273,275 | A * | 9/1966 | Badali | 42/50 |
| 3,395,479 | A * | 8/1968 | Collins | 42/50 |
| 4,109,401 | A * | 8/1978 | Musgrave | 42/50 |
| 4,139,958 | A * | 2/1979 | Foote | 42/49.02 |
| 4,142,313 | A * | 3/1979 | Musgrave | 42/1.02 |
| 4,216,601 | A * | 8/1980 | Musgrave | 42/1.02 |
| 4,219,953 | A * | 9/1980 | Musgrave | 42/1.02 |
| 4,446,645 | A * | 5/1984 | Kelsey et al. | 42/50 |
| 4,502,237 | A * | 3/1985 | Krogh | 42/50 |
| 4,862,618 | A | 9/1989 | Szabo | |
| 4,888,900 | A | 12/1989 | Howard | |
| 5,099,595 | A | 3/1992 | Chesnut et al. | |
| 5,263,273 | A | 11/1993 | Lishness | |
| 5,329,718 | A * | 7/1994 | Howard | 42/50 |
| 5,345,660 | A * | 9/1994 | Howard | 42/49.1 |
| 5,450,683 | A * | 9/1995 | Miller, IV | 42/50 |
| 5,615,505 | A | 4/1997 | Vaid | |
| 5,664,355 | A * | 9/1997 | Ronkainen | 42/18 |
| 5,956,878 | A | 9/1999 | Yang | |
| 6,256,918 | B1 | 7/2001 | Szabo | |
| 6,283,006 | B1 | 9/2001 | Szabo et al. | |
| 6,557,288 | B2 | 5/2003 | Szabo | |
| 6,560,907 | B1 * | 5/2003 | Vieweg | 42/50 |
| 6,952,894 | B1 * | 10/2005 | Vieweg | 42/50 |
| 7,047,686 | B2 * | 5/2006 | Zimmermann | 42/75.1 |
| 2004/0020096 | A1 * | 2/2004 | Tal et al. | 42/87 |

* cited by examiner

*Primary Examiner*—Troy Chambers
(74) *Attorney, Agent, or Firm*—Finnegan, Henderson, Farabow, Garrett & Dunner, L.L.P.

(57) ABSTRACT

Embodiments of the invention are directed to a magazine and follower assembly for use with a semi-automatic handgun. The assembly may include a magazine body configured to be received within a recess in a handgun. The magazine body has an open top end including a pair of magazine lips sized to retain cartridges within the magazine body. A follower is housed within the magazine body and is biased against the force of a compression spring. The follower has a resting face configured to accommodate the outside profile of a cartridge body and further includes a protrusion disposed along the resting face. The protrusion maintains contact between the magazine lips and an uppermost cartridge loaded within the magazine body.

50 Claims, 8 Drawing Sheets

SEMI-AUTOMATIC HANDGUN, MAGAZINE, AND FOLLOWER

FIELD OF THE INVENTION

The present invention relates to an improvement in a semi-automatic handgun and, more particularly, the present invention relates to a magazine and follower assembly for a semi-automatic handgun.

BACKGROUND OF THE INVENTION

A semi-automatic handgun is designed to fire a round of ammunition when the handgun's trigger is pulled. Each semi-automatic handgun operates in a firing cycle during which the round of ammunition is moved from a storage location, such as a magazine, to a chamber in the handgun. This is the "feed" portion of the firing cycle. The round of ammunition is then fired and the spent ammunition casing, or shell, is extracted from the chamber and ejected from the handgun so that a new round may be loaded for firing.

Typically, each semi-automatic handgun includes a slide that governs the movement of the ammunition round, or cartridge, during the firing cycle. The slide moves between a rearward position and a forward position on the handgun. As the slide moves from the rearward position to the forward position, the slide advances a cartridge from the magazine and moves the cartridge into the chamber and into position for firing.

Each round of ammunition typically includes a casing, a propellant, a primer, and a projectile. The casing houses the propellant, the primer, and the projectile. The round is fired when a mechanical force, such as from a firing pin or a striker, is delivered to the primer in the casing. The force ignites the primer, which in turn ignites the propellant. The gas from the rapidly burning propellant propels the projectile down the barrel.

After the round is discharged, the force of the discharge causes the slide to move towards the rearward position. As the slide retracts, an extractor pulls the casing away from the chamber and an ejector causes the casing to disengage from the extractor and exit the handgun through an ejection port in the slide. The slide continues moving rearward compressing a recoil spring until it reaches its rearmost position. Under the influence of the recoil spring, the slide then returns to its forward position over the magazine and loads another cartridge into the chamber in the process.

A jam or misfeed situation may occur when the handgun experiences a problem in the "feed" portion of the firing cycle. This type of situation may arise when, for example, the round of ammunition is not properly fed into the chamber. Improper feeding of a cartridge can result when the cartridge about to be loaded into the chamber lies at an improper rest angle within the magazine body. When the breech bolt face of a handgun's slide contacts such a misaligned round, the handgun may fail to feed the cartridge and place it in the chamber. In this circumstance, the firing cycle is interrupted and the user must manually resolve the problem by helping to guide the round of ammunition into the chamber.

Conventional magazines for semi-automatic handguns are used to store multiple rounds of ammunition, or cartridges, for consecutive loading and firing. Most magazines comprise a hollow magazine body having an open end and a closed end. In addition, magazines usually house a compression spring that extends between the closed end and a follower element that supports a vertical stack of cartridges. Cartridges are loaded into the magazine one at a time, with the first loaded cartridge disposed on the follower and subsequent cartridges being disposed against the body of the preceding cartridge, against the force of the compression spring. The loaded magazine is shaped to fit within an opening in the handle of the handgun.

Magazine lips are located along the open end of a magazine body. The lips include shaped upper edge portions that extend inwardly toward each other to such a distance as to slidably fit a single cartridge. The lips assure that the loaded cartridges do not exit the magazine body as a result of the compression spring force. The force of the compression spring against the follower, in turn, biases the vertical stack of cartridges upward within the magazine body. When the magazine is inserted into the opening in the handle of a handgun, the spring force ideally maintains the highest cartridge in the proper position for movement between a storage location in the magazine and a firing location within the chamber at a rear end of the handgun's barrel.

Many followers for handgun magazines consist of a piece of sheet metal properly profiled to slide easily inside the magazine body under the force generated by the compression spring and to simultaneously create a sufficient contact area with the cartridge in order to push up each round against the magazine lips. Many other followers for handgun magazines are made from injected plastic having profiles that basically ensure the same functions of the followers made from sheet metal. Both types of followers align and maintain firm contact between the uppermost cartridge and the magazine lips during the feeding process.

Most followers include a surface for contacting and maintaining cartridges at a predetermined position relative to the magazine lips. Whenever there is more then one cartridge loaded in the magazine the spring force will create a simultaneous alignment between cartridge and follower on one side of the lowermost cartridge, and between the uppermost cartridge and magazine lips. This is due to the relative movement of the follower within the magazine body. When the position of a follower tilts relative to the magazine body, as most often happens when only a single cartridge remains in the magazine, the surface of the cartridge contacting the follower may rest at an angle significantly above or below that required for proper feeding.

In light of the foregoing there is a need for an improved magazine and follower assembly for a semi-automatic handgun that will reduce the likelihood of a jam or misfeed situation during the firing cycle of the handgun. This is achieved by a magazine follower that compensates for cartridges improperly resting at angles both above and below those required for proper cartridge feeding in order to maintain a consistent alignment of each uppermost round with the magazine lips.

SUMMARY OF THE INVENTION

Embodiments of the present invention are directed to a semi-automatic handgun having a magazine and follower assembly that obviates one or more of the limitations and disadvantages of prior magazines and followers.

In one embodiment, the invention is directed to a magazine and follower assembly. The assembly includes a magazine body configured to be received within a recess in a handgun. The magazine body has a closed bottom end, a front wall, a back wall, left and right side walls, and an open top end including a pair of magazine lips sized to retain cartridges within the magazine body. A compression spring is housed within the magazine body and is disposed against the closed bottom end of the magazine body. A follower is configured for movement within the magazine body against the force of the compression spring. The follower has a resting face and a protrusion. The protrusion is disposed along, and movable relative to, the resting face and the protrusion is configured to impart a vertically directed force against a cartridge in contact with the follower in order to maintain proper contact and alignment between an uppermost cartridge within the magazine body and the magazine lips.

In another embodiment, the invention is directed to a semi-automatic handgun. The semi-automatic handgun includes a frame having a grip that has a magazine entrance. The handgun further comprises a slide disposed on the frame for movement between a forward position and a rearward position, and a handgun barrel received within the slide and linked to the frame. A magazine is received within the magazine entrance. The magazine comprises a hollow magazine body having an open top end including a pair of magazine lips sized to retain cartridges within the magazine body. A compression spring is housed within the magazine body. A follower is configured for movement within the magazine body against the force of the compression spring. The follower has a resting face and a protrusion. The protrusion is disposed along, and movable relative to, the resting face and the protrusion is configured to impart a vertically directed force against a cartridge in contact with the follower in order to maintain proper contact and alignment between an uppermost cartridge within the magazine body and the magazine lips.

In another embodiment, the invention is directed to a magazine follower. The follower is configured for movement within the magazine body against the force of a compression spring. The follower has a resting face and a protrusion. The protrusion is disposed along, and movable relative to, the resting face and the protrusion is configured to impart a vertically directed force against a cartridge in contact with the follower in order to maintain proper contact and alignment between an uppermost cartridge within the magazine body and magazine lips.

Additional objects and advantages of the invention will be set forth in part in the description which follows, and in part will be obvious from the description. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments of the invention, examples of which are illustrated in the accompanying drawings. Wherever possible, the same reference numbers will be used throughout the drawings to refer to the same or like parts.

In accordance with the present invention, a magazine and follower assembly for a semi-automatic handgun is provided. In the accompanying drawings and by way of example, a 1911A1 type handgun is illustrated and described. It should be noted, however, that the present invention may be applied to magazines for use with other models or types of semi-automatic handguns. The invention is not intended to be limited to use in any particular model of firearm.

The 1911A1 model handgun is disclosed in U.S. Pat. No. 984,519, which is hereby incorporated by reference. U.S. Pat. No. 984,519 discloses the overall structure and operation of the 1911A1 handgun and its disclosure of the basic structural components and operation will not be repeated. The present invention may also be applied to handguns that include variations on the conventional 1911A1 design, such as, for example, those handguns described in U.S. Pat. Nos. 6,283,006; 6,415,702; and 6,557,288, which are hereby incorporated by reference. An exemplary 1911A1 type handgun is shown in FIG. 1 and is designated generally by reference number 10.

Figure 1:
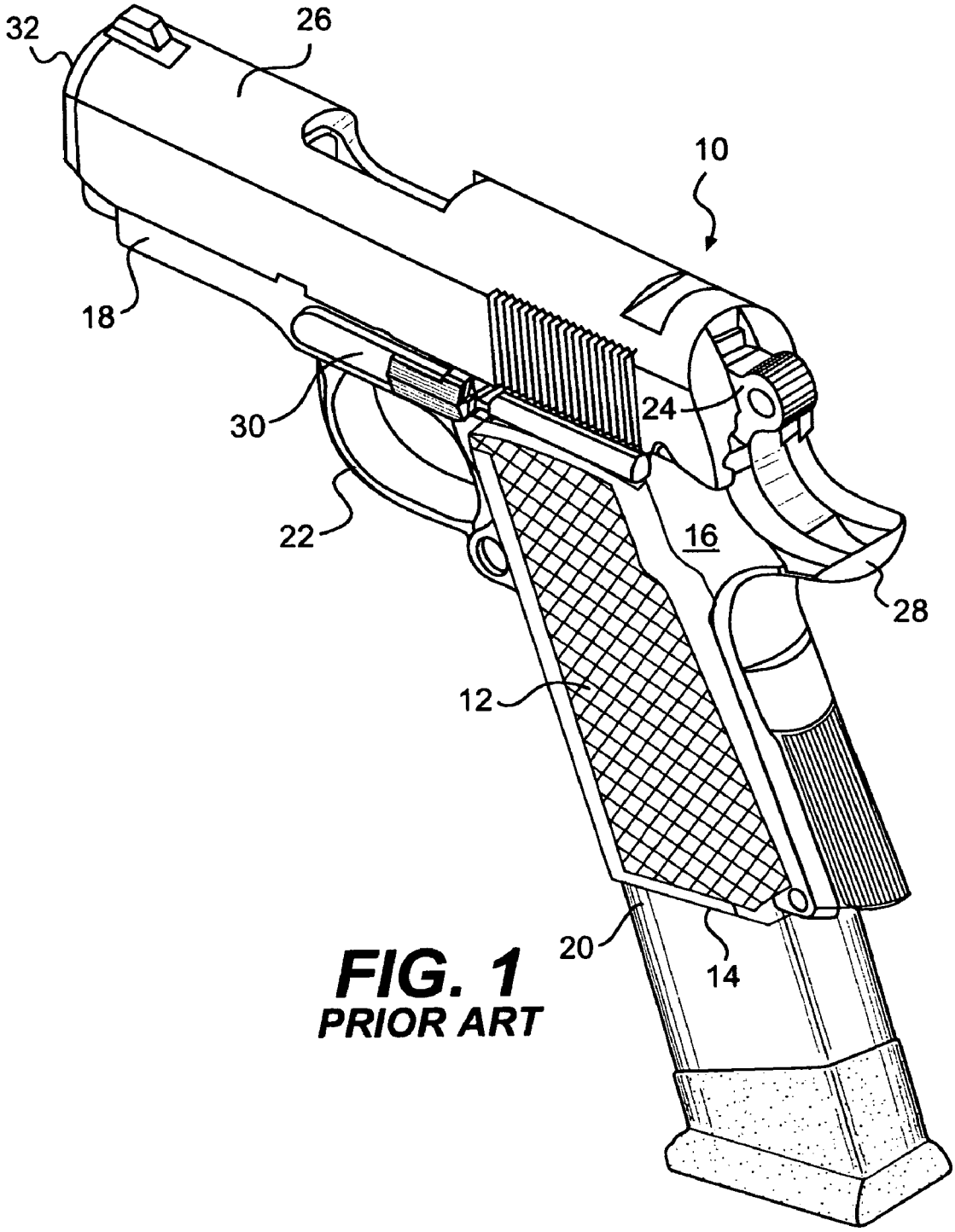
FIG. 1 PRIOR ART
FIG. 1 is perspective view of a 1911A1 type semi-automatic handgun.

As best illustrated in FIG. 1, semi-automatic handgun 10 includes a handle portion, or grip 12, that has a magazine well 14 configured to receive a magazine 20. In an embodiment of the present invention, the magazine is a single stack magazine, i.e. one that houses a single column of cartridges stacked, one on top of the other. While the present embodiment utilizes the single stack magazine, it is contemplated that a high-capacity magazine, such as disclosed in U.S. Pat. No. 4,862,618, could be modified to incorporate the advantages of the present invention. The structure and operation of a high-capacity magazine is disclosed, for example, in U.S. Pat. No. 4,862,618, which is hereby incorporated by reference.

As further illustrated in FIG. 1, a conventional semi-automatic handgun includes a frame 16. Frame 16 includes a slide support 18, the magazine well 14, disposed at the lower end of the grip 12, and a trigger guard 22. Frame 16 mounts a hammer 24 that is disposed at the rear of the handgun and a slide 26 that is disposed on slide support 18 at the top of the handgun, and a grip safety 28 that is disposed at the rear of the handgun. Slide 26 is shown in its fully forward closed position in FIG. 1. In addition, frame 16 also mounts a conventional slide stop 30.

Slide 26 is mounted on the frame 16 for reciprocating movement between a forward position and a rearward position. Slide 26 may include a pair of grooves (not shown) that are adapted to engage a pair of corresponding rails (not shown) on the top of frame 16. The engagement of the grooves of slide 26 and the rails on frame 16 allow slide 26 to slide between a forward position (as illustrated in FIG. 1) and a rearward position (as illustrated in FIG. 2).

Figure 2:
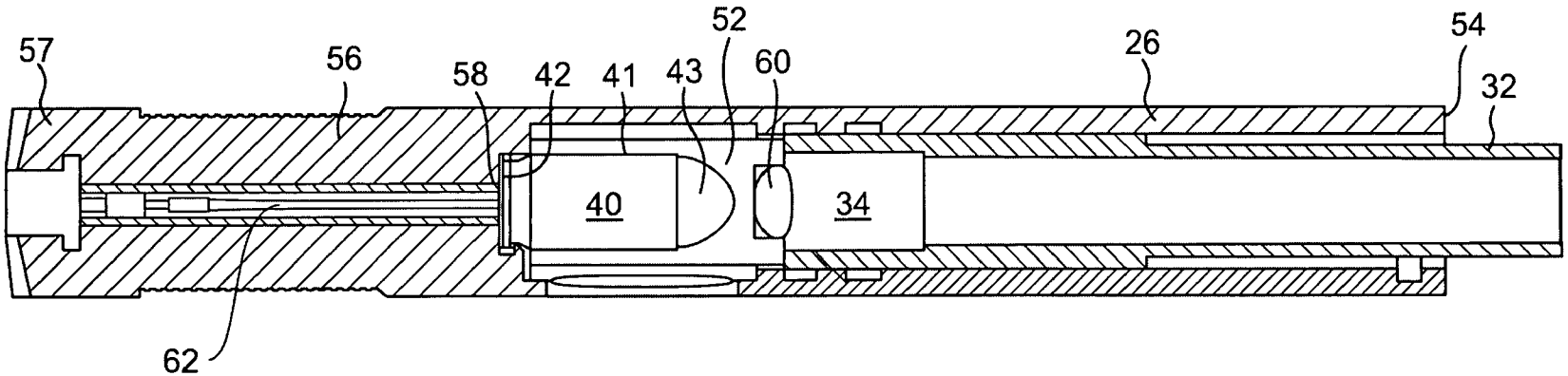
FIG. 2 Prior Art
FIG. 2 is a top cross-sectional view of a slide, frame, and barrel of a 1911A1 type semi-automatic handgun, illustrating the slide in a rearward position.

FIG. 2 illustrates a top cross-sectional view of the slide 26 and frame 16, with the slide 26 in the rearward position on frame 16. FIG. 2 further illustrates a handgun barrel 32 having a chamber 34 configured to receive a round of ammunition, or cartridge 40 fed from the magazine. Cartridge 40 may include a casing 41 having a rim 42. Cartridge 40 may also include a propellant and primer disposed in casing 41 and a projectile 43.

Barrel 32 is connected to frame 16 through a pivoting link (not shown). The rear end of barrel 32 is adjacent a feed ramp 52 (See FIGS. 7-9) for guiding cartridges into the chamber 34 during the feeding and chambering process. The slide 26 includes a breech configured to interface with a round of ammunition. As illustrated in FIG. 2, the slide 26 includes a front end 54 and a rear end 57. Front end 54 includes a barrel opening that is configured to surround barrel 32. The rear end of the slide 26 includes a breech face 58 adapted to contact the rear portion of cartridges 40. Breech face 58 is adapted to engage cartridge 40 held by a magazine as slide 26 moves from the rearward position to the forward position. As slide 26 moves to the forward position, breech face 58 moves cartridge 40 up both a feed ramp 52 and the barrel ramp 60 and ultimately into chamber 34.

The plane within which the cross section of FIG. 2 takes place includes a firing pin opening 62 that runs from the rear end of slide 26 and extends through to breech face 58. The size of the firing pin opening 62 may become narrower as it approaches the breech face 58. The firing pin opening 62 is configured to receive a firing pin (not shown) and to position the firing pin between hammer 24 and a loaded cartridge 40 housed in chamber 34. When the hammer 24 is actuated so as to strike the firing pin, the resulting force of the firing pin against the primer in the case in turn ignites the propellant. As described above, the gas from the rapidly burning propellant then propels the projectile down the barrel to thereby discharge the bullet in the round 40.

Figure 3A:
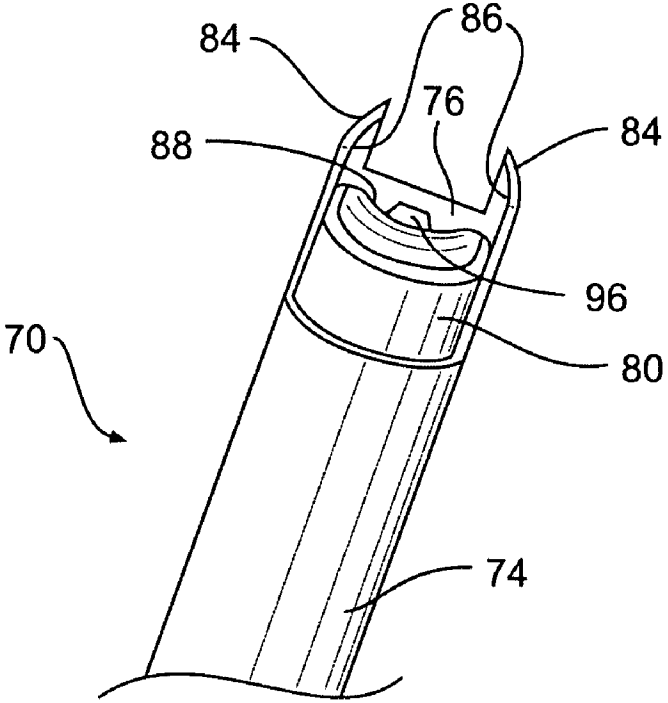
FIG. 3A is a view of the magazine and magazine follower shown from the direction of arrow 3A in FIG. 3.
Figure 3:
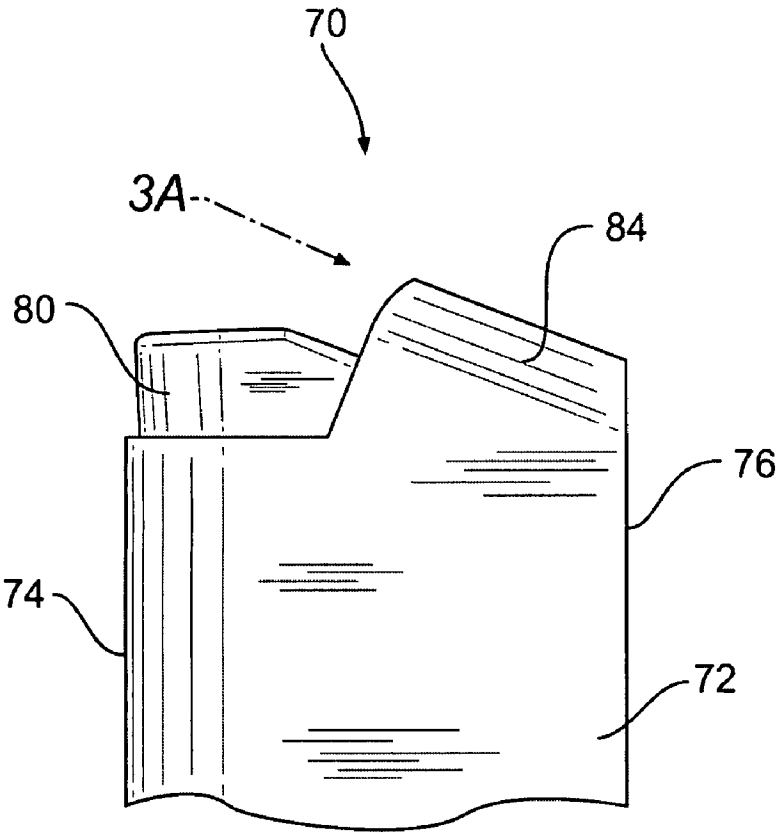
FIG. 3 is a fragmentary side view of the top portion of a magazine and magazine follower of the present invention.

Referring to FIG. 3, a side view of the top portion of one embodiment of a magazine 70 is illustrated. Magazine 70 includes a magazine body 72 having front and back wall portions 74 and 76 respectively. Follower 80 is illustrated in a rest position, resulting from the force of an internal compression spring (see FIGS. 4-5), at its uppermost point closest to the top of the magazine body. Magazine lips 84 are located at a top portion of the magazine body and are disposed to properly guide a cartridge at a predetermined angle toward a handgun chamber during the feeding and chambering process.

FIG. 3A illustrates magazine 70 and follower 80 shown from the direction of arrow 3A in FIG. 3. The view of FIG. 3A reveals the inner surfaces 86 of magazine lips 84 which are intended to remain in firm contact with a cartridge body. The Magazine lips 84 are located along the open end of the magazine body 72. The lips 84 include shaped upper edge portions that extend inwardly toward each other to such a distance as to slidably fit a single cartridge. The lips 84 assure that the loaded cartridges do not exit the magazine body resulting from the force of the internal compression spring (see FIGS. 4-5).

The view of FIG. 3A illustrates the concave resting face 88 of follower 80, shaped to accommodate the outside profile of the cartridge body. The back wall portion 76 of the magazine body also includes a cut out portion, shaped to expose the back face of a loaded cartridge for contact with the forward movement of the breech face 58 (See FIGS. 2 and 7-9). In addition, the view of FIG. 3A illustrates a protrusion 96 extending from the resting face 88.

Figure 4:
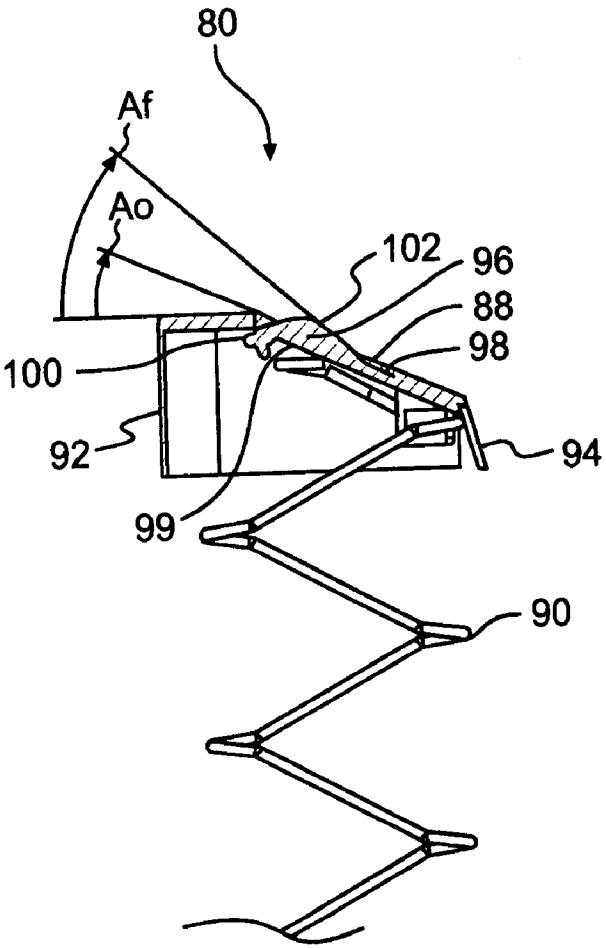
FIG. 4 is a side cross-sectional view of a magazine follower having a protrusion situated at an upright position.

FIG. 4 is a side cross-sectional view of a magazine follower 80 and compression spring 90 in accordance with one embodiment of the present invention. FIG. 4 illustrates a cross-section of follower 80 along line 4-4 of FIG. 6B. Follower 80 of FIG. 4 includes a front face 92, springs tabs 94, located along the rear portion of the follower 80, and the protrusion 96. The protrusion 96 may be integrally formed with the rest of the follower structure and positioned within a cut out area 97 (depicted in FIGS. 6A and 6B) in the follower main resting face 88. The protrusion 96 may be joined to the follower body at one end by an integral hinge element 98. The underside of the protrusion 96 may be provided with a cut out portion 99 to accommodate an uppermost coil portion of the compression spring 90. The contact between an uppermost coil portion of compression spring 90 and the bottom of protrusion 96 may generate a vertically directed force against the underside of protrusion 96. This vertically directed force, in turn, generates upward rotation of the protrusion 96 about the hinge 98. The upward rotation is limited by the location of a protuberance 100 along the protrusion, at an end opposite the end containing the hinge 98.

In a full upward rotated position, protrusion 96 extends above the main resting face 88 and generates what is termed a compensatory rotational angle. The function of the compensatory rotation angle is to adjust the angle of the round 40 with respect to the magazine to ensure it is presented at the correct angle for feeding the round 40 into the chamber 34. As depicted in the embodiment of FIG. 4, the resulting compensatory angle is measured by the difference between final angle Af, created by an inclined surface of the protrusion 96 and a horizontal plane, and the normal angle Ao, created by main resting face 88 and the same horizontal plane. As seen in FIG. 4, the protrusion 96 may itself be shaped to include a projection 102 located thereon and configured to contact a cartridge during use.

While the shape and profile of protrusion 96 may take alternative forms and configurations other than the specific shapes disclosed in the accompanying figures, the function of the protrusion remains consistent. The upward rotation and vertically directed force generated by protrusion 96 acts upon a cartridge remaining within the magazine and in contact with the follower 80. The protrusion generates a force against a cartridge at a point that helps maintain proper contact and alignment between the uppermost cartridge within the magazine and the magazine lips 84.

Figure 5:
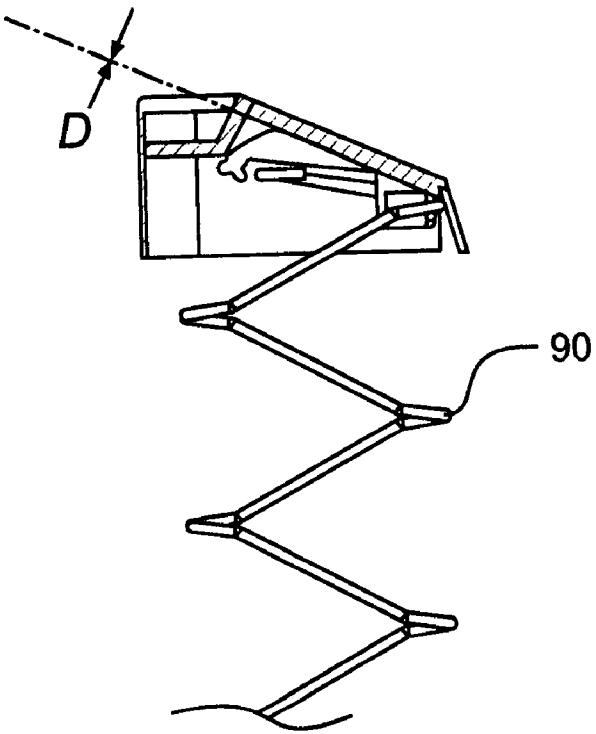
FIG. 5 is a side cross-sectional view of a magazine follower having a protrusion situated at a downward position.
Figure 6B:
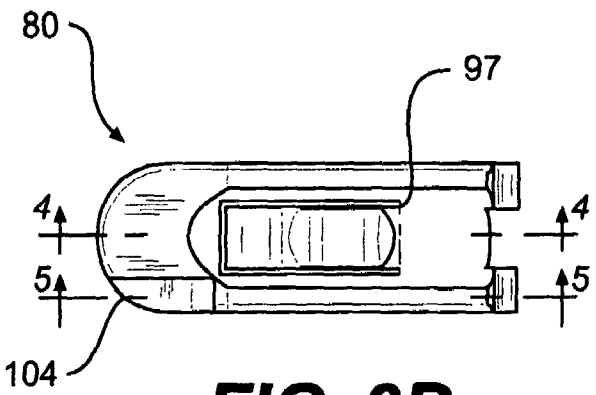
FIG. 6B is a top view of a magazine follower showing an embodiment of the present invention.
Figure 6D:
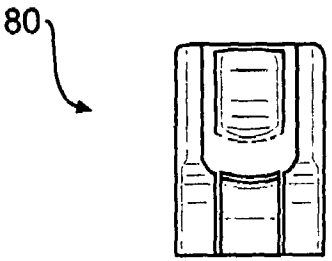
FIG. 6D is a rear view of a magazine follower showing an embodiment of the present invention.

FIG. 5 is a cross-section of follower 80 along line 5-5 of FIG. 6B depicting protrusion 96 angled in a downward position below the main resting face 88. In FIG. 5, the inclined surface of the protrusion 96 is shown in alignment with the main resting face 88 of follower 80. Whenever the compensatory rotational angle and vertically directed force are not required, such as, for example, when the main resting face 88 maintains the proper contact and angle between a cartridge body and the magazine lips, the resulting distance D between main resting face 88 and the inclined surface of protrusion 96 is equal to zero.

Figure 6A:
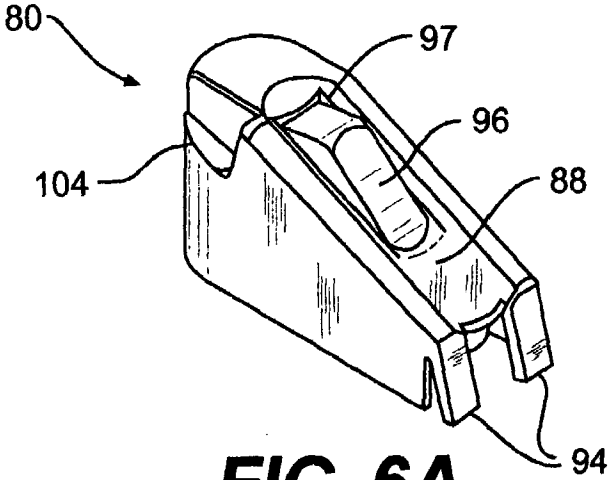
FIG. 6A is a perspective view of a magazine follower showing an embodiment of the present invention.

FIGS. 6A-6D represent, perspective, top, side, and rear views respectively, of one embodiment the follower 80. In each of the four figures, the protrusion 96 is illustrated in a fully rotated, upward position. Spring tabs 94 and the follower front face 92 help the follower 80 maintain a correct position during translation within the magazine body 72. With particular reference to FIGS. 6A and 6B, follower 80 includes a cut out portion 97 along the main resting face 88 for accommodating the protrusion 96. As seen in the perspective view of FIG. 6A, both the main resting face 88 and the inclined surface of protrusion 96 may be formed having a concave shape in order to accommodate the outside profile of a round of ammunition.

As noted above, the follower 80 and protrusion 96 may be constructed of an integral single piece design where the protrusion is connected to the follower through hinge element 98. In such a configuration the single piece may be formed of a low cost material, for example, such as, a thermoplastic such as nylon. In addition, the follower may be configured such that the protrusion 96 rests above the main resting face 88 and itself generates a vertically directed force by being resiliently biased in an upward direction. The material of construction may be selected such that the protrusion 96 generates its own predetermined vertically directed force by constructing the hinge element 98 with a predetermined spring rate. The selection of a particular predetermined spring rate, should be specifically suited to assist in the underlying purpose of maintaining proper contact and alignment between the uppermost cartridge within the magazine and the magazine lips 84.

Figure 6C:
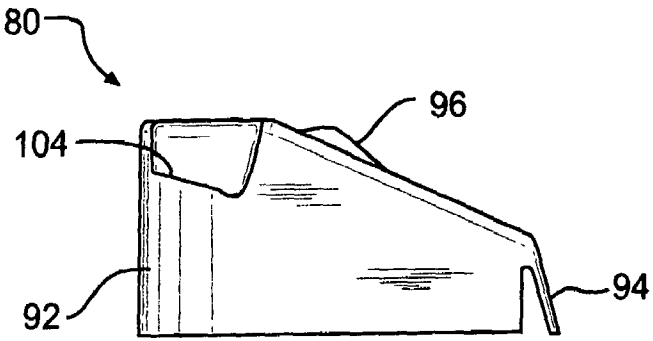
FIG. 6C is a side view of a magazine follower showing an embodiment of the present invention.

FIGS. 6A-6C also depict a lowered engagement portion 104 along the follower 80. When no cartridges remain within the magazine body, the lowered engagement portion 104 of the follower exerts an upward force upon, and raises, an internal portion of slide stop 30. The slide stop, in turn, prevents further movement of slide 26, it remains rearward after the last round is fired, and thereby indicates that the magazine is currently empty.

Figure 7:
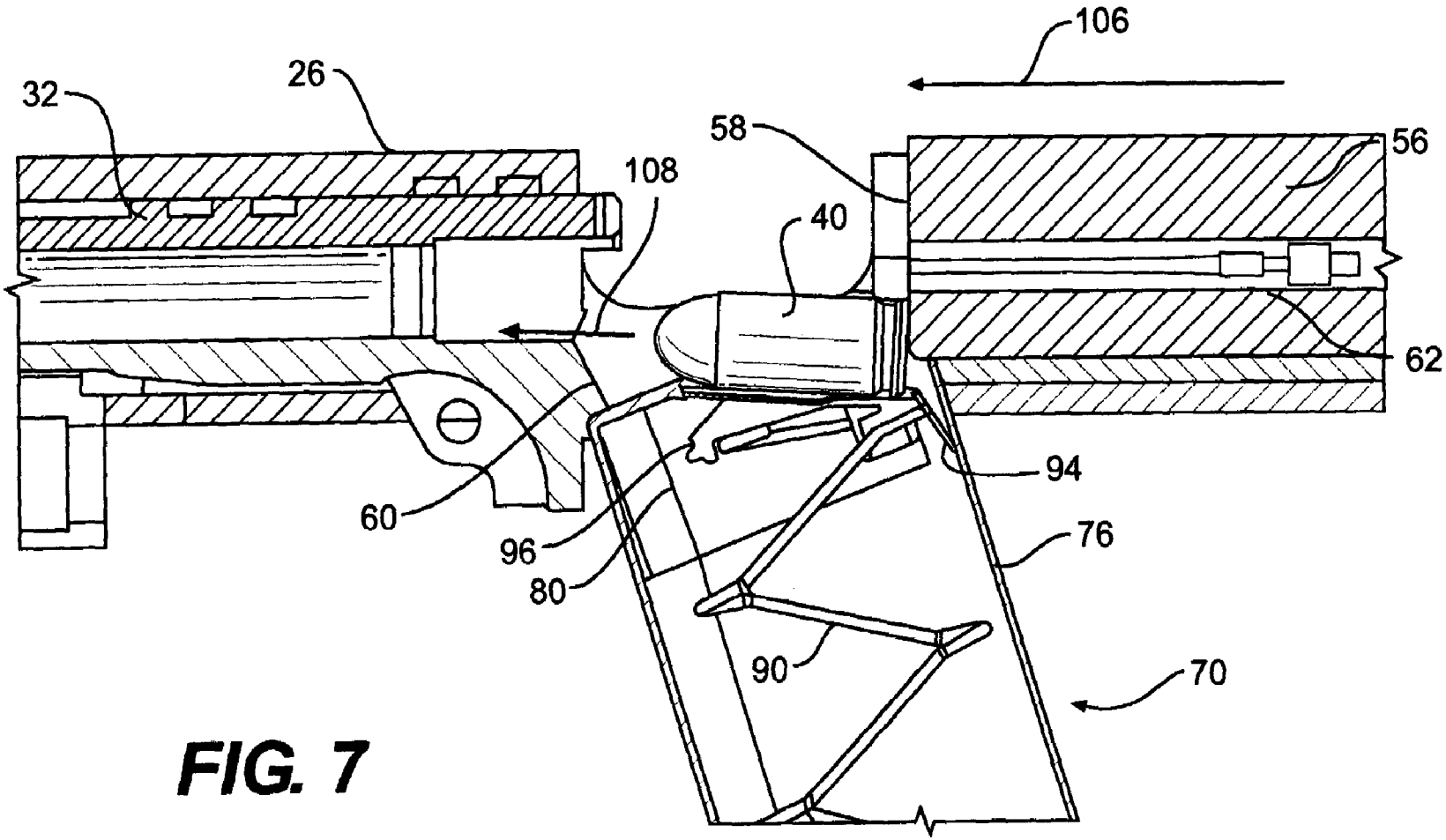
FIG. 7 is a cross-sectional view of a magazine and follower disposed within a semi-automatic handgun illustrating the normal feeding process for a cartridge.

Referring now to FIG. 7, magazine 70 and follower 80 are shown disposed within a semi-automatic handgun during the first stage of the feeding process for a cartridge 40. In the first stage of the feeding process, the slide 26, including breech face 58, travels forward toward the slide position of FIG. 1. A portion of the breech 56 is dimensioned to pass through the cut out portion of the back wall of magazine 70, thereby making contact with a rear end of the cartridge 40 to be fed. FIG. 7 illustrates a cartridge 40 in proper alignment within the magazine body 70. Arrow 106 represents the direction of forward slide movement and arrow 108, in turn, depicts the normal direction of cartridge movement during the feeding process. As the breech face 58 engages the rear end of cartridge 40, the cartridge is pushed forward over the barrel ramp 60 and into the chamber 34. When the cartridge 40 is in proper alignment with the magazine body, as depicted in FIG. 7, the cartridge body will rest upon main resting face 88 and the protrusion 96 will not extend above the follower's main resting face 88.

Figure 8:
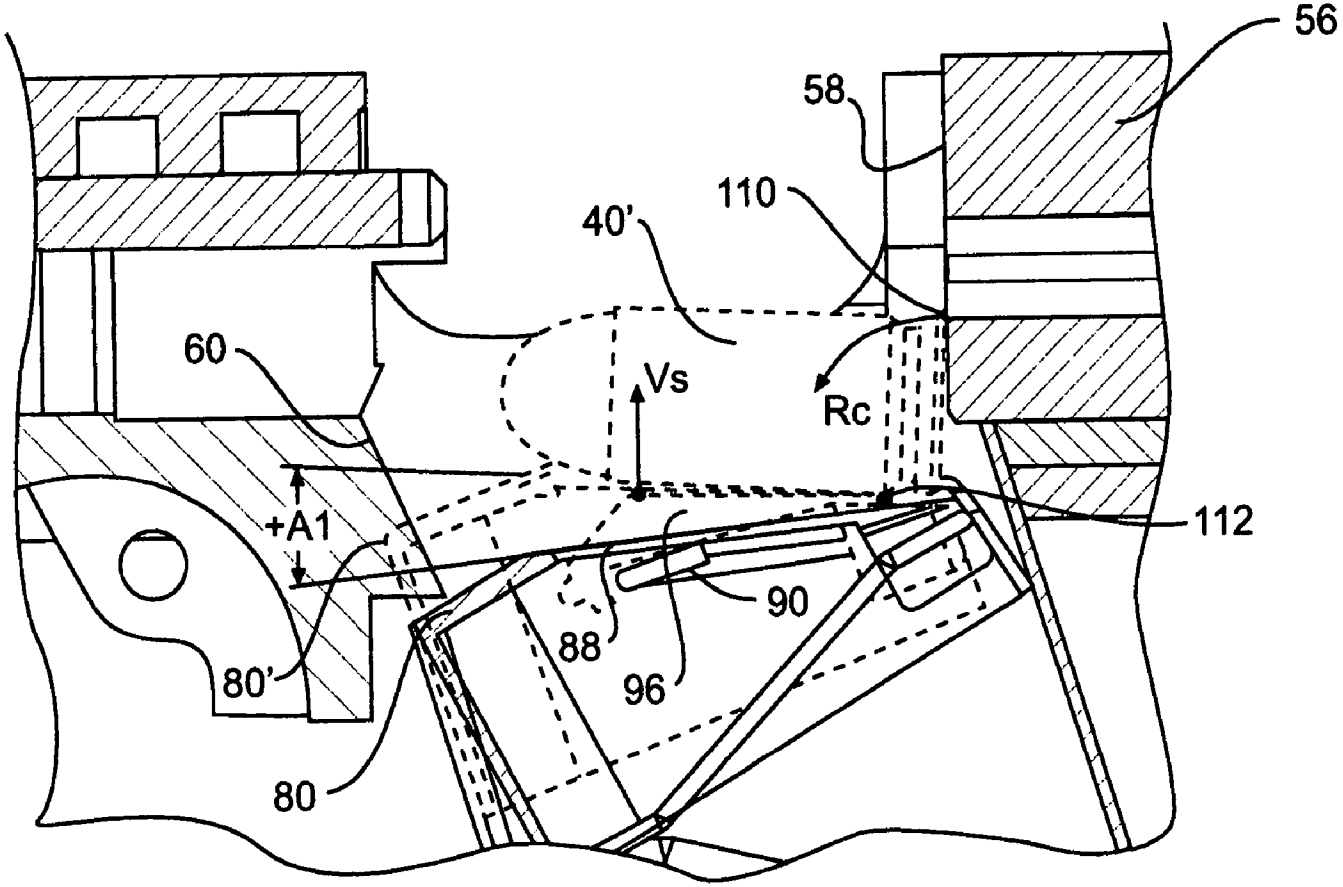
FIG. 8 is a cross-sectional view of a magazine and follower disposed within a semi-automatic handgun illustrating the follower compensating for an improper cartridge feed angle.

FIG. 8 also depicts one embodiment of a magazine and follower disposed within a semi-automatic handgun during the first stage of the feeding process for a cartridge. In FIG. 8, the follower 80, depicted in solid continuous lines, is misaligned and tilted within the magazine body. The proper position is represented by follower 80' and cartridge 40', illustrated in dashed lines. Normally, due to this misalignment, the surface of a cartridge contacting the follower 80 would rest along face 88, significantly below that required for proper feeding. Without the benefits of protrusion 96, when the breach face 58 begins to push the cartridge forward, a pushing force is applied at point 110 along the rear end of cartridge 40'. Due to the application of force at point 110, a counter-clockwise rotational moment Rc develops around point 112.

Angle A1 is the angle between the position of the cartridge 40', when it contacts the misaligned follower face 88 (depicted in solid lines), and the proper cartridge position 40' in alignment with the magazine lips shown in dashed lines. Without the protrusion 96, the main resting face 88 instead of magazine lips now guides the cartridge 40. In this position a misaligned cartridge would meet the barrel ramp 60 at the wrong angle. This improper angle can cause a gun to jam during the feeding process.

In the presence of the protrusion 96, despite the improper tilted position of the follower 80 and its face 88, the compression spring 90 (and possibly the vertically directed force generated from potential resilient upward biasing of protrusion 96, described above) continues to push the protrusion 96 up to the point where the angle A1 is eliminated. The protrusion 96 serves to correct the misalignment and position the cartridge in the proper position, represented by dashed lines 40' in FIG. 8. Accordingly, proper contact between the cartridge 40' and the magazine lips is re-established. This effect is due to the vertical component of the spring force Vs that creates a counteracting (clockwise) rotational moment around the same point 112, but in an opposite direction. As noted above, this vertically directed spring force may be generated by an uppermost coil portion of the compression spring 90, an upward resilient biasing of protrusion 96, or a combination of both.

Figure 9:
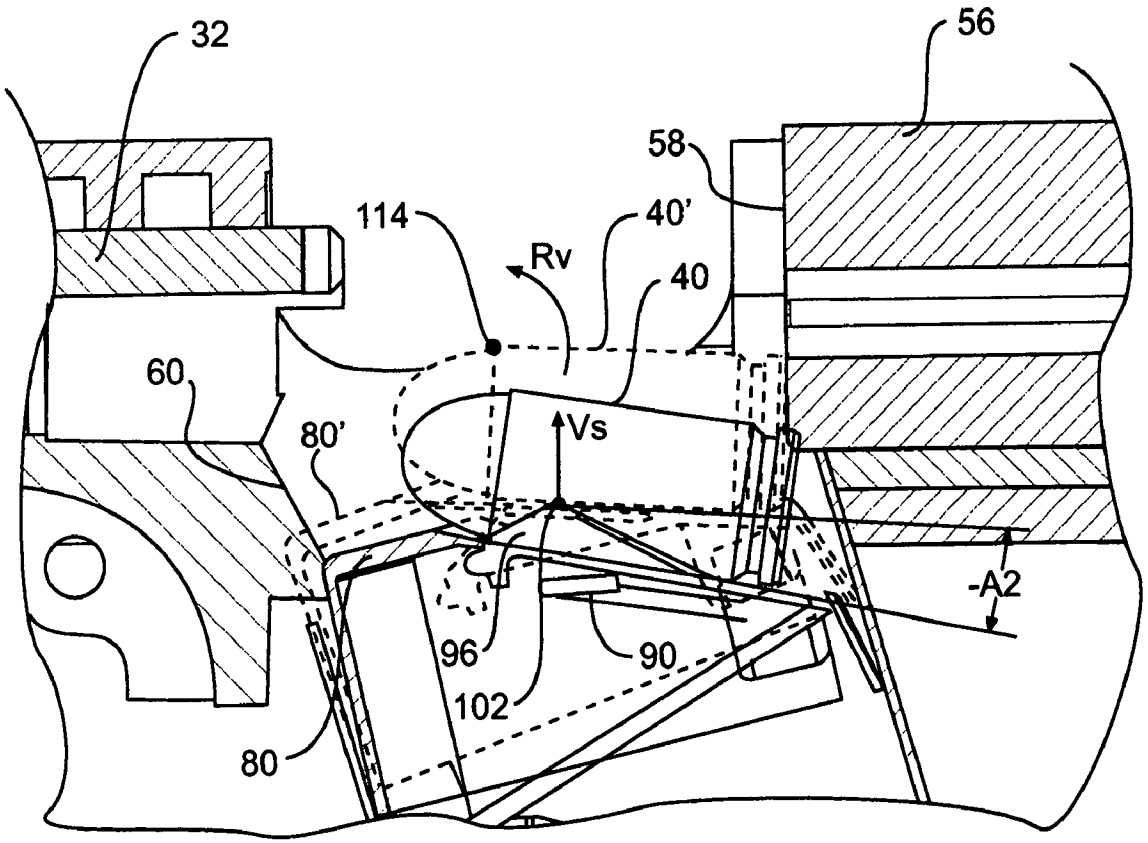
FIG. 9 is a cross-sectional view of a magazine and follower disposed within a semi-automatic handgun illustrating the follower compensating for an improper cartridge feed angle, different from the angle shown in FIG. 8.

FIG. 9 is another depiction of a magazine and follower disposed within a semi-automatic handgun during the first stage of the feeding process for a cartridge. In FIG. 9, the follower 80 and cartridge 40, depicted in solid continuous lines, are misaligned and tilted within the magazine body. The proper position is represented by follower 80' and cartridge 40', illustrated in dashed lines. Due to this tilted misalignment, the surface of the cartridge 40 contacting the follower 80, will rest at an angle A2, significantly above that required for proper feeding.

Without the protrusion 96, the direction of the cartridge 40 is misaligned. This misalignment may cause a problem in the feed cycle when the beech face 58 acts upon the upper portion of the rim of cartridge 40. As a result of this improper alignment, a clockwise directed moment will act upon the misaligned cartridge 40 during forward movement of the breech bolt 56 during the feeding process. The cartridge 40 could improperly load and may get caught in a vertical position between the barrel 32 and the breech bolt 56.

When the follower includes the protrusion 96, the angle A2 is eliminated. The projection 102 is designed to engage the cartridge 40', depicted in dashed lines, at a predetermined location so as to counteract the clockwise directed moment resulting from the angle A2. As seen in FIG. 9, a vertical component Vs of the compression spring force (and possibly the vertically directed force generated from potential resilient upward biasing of protrusion 96, described above) creates a counter-clockwise directed moment Rv about point 114. As a result of the force imparted by protrusion 96, proper contact between the cartridge 40' and the magazine lips is re-established.

With reference to both FIGS. 8 and 9, the protrusion 96, is positioned at a specific predetermined location along the follower's main resting face so as to counteract instances of misaligned cartridges during a handgun's feeding cycle. The position is selected to counteract problems resulting from cartridges 40 that improperly rest at angles both above and below those required for proper cartridge feeding. The particular location of the protrusion 96 and projection 102 along the followers main resting face is selected to most effectively and most efficiently counteract both clockwise and counterclockwise moments that act upon misaligned cartridges 40 during a loading cycle. The specific dimensions related to this location will change depending upon factors, such as, for example, the caliber of ammunition and the design of semi-automatic handgun within which the follower is intended to be used.

An additional advantage of the follower and protrusion configuration is the use of a single compression spring to perform both the function of guiding the follower main resting face 88 within the magazine body as well as imparting the additional force to the protrusion 96 in the event of a misaligned cartridge. This combination provides not only additional cost savings, but also presents less additional moving parts to the overall assembly, in addition to reducing the instances of malfunction.

The integral design of hinge element 98, allows for additional cost savings. Because the protrusion 96 is integral with the rest of the follower design, both the protrusion and remaining follower structure can be molded from the same low cost type material in a single piece design.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A magazine assembly comprising:

a magazine body configured to be received within a recess in a handgun, the magazine body having a bottom end, a front wall, a back wall, left and right side walls, and an open top end including a pair of magazine lips disposed to retain cartridges within the magazine body;

a compression spring housed within the magazine body and disposed against the bottom end of the magazine body;

a follower configured for movement within the magazine body against the force of the compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein the protrusion does not extend above the main resting face when a cartridge body is simultaneously maintained in contact with the main resting face on one side and the magazine lips on an opposite side.

2. The assembly of claim 1, wherein the protrusion and follower are formed of a single integral piece.

3. The assembly of claim 1, wherein the protrusion and follower are formed of a molded thermoplastic material.

4. The assembly of claim 3, wherein the molded thermoplastic material is nylon.

5. The assembly of claim 1, wherein the main resting face of the follower has a concave shape configured to accommodate the outside profile of a cartridge body.

6. The assembly of claim 1, wherein the main resting face of the follower includes a cut out area for accommodating the protrusion.

7. The assembly of claim 1, wherein an underside of the protrusion includes a cut out portion that accommodates an upper portion of the compression spring such that contact between the compression spring and protrusion provides upward movement of the protrusion relative to the main resting face of the follower.

8. The assembly of claim 7, wherein the protrusion is joined to the main resting face by an integral hinge, such that the compression spring provides rotational movement of the protrusion about the hinge.

9. The assembly of claim 8, further comprising a protuberance located on the protrusion at an end opposite the integral hinge, the rotation of the protrusion about the hinge being limited by contact of the protuberance with an underside of the main resting face.

10. The assembly of claim 9, wherein the protrusion includes a projection configured to contact a cartridge loaded within the magazine body, at a predetermined location during upward rotation of the protrusion such that a clockwise or counterclockwise moment is generated to act upon a misaligned cartridge during a handgun loading cycle.

11. The assembly of claim 1, wherein the magazine lips include shaped upper edge portions that extend inwardly toward each other to such a distance as to slidably fit a single cartridge.

12. The assembly of claim 1, wherein the follower includes a lowered engagement portion for contacting a slide stop within a semi-automatic handgun when no cartridges remain within the magazine body.

13. The assembly of claim 1, wherein the left and right side walls of the magazine body are spaced so as to accommodate more than one column of cartridges in a staggered high capacity configuration.

14. The assembly of claim 1, wherein the protrusion rests above the main resting face and generates a vertically directed force by being resiliently biased in an upward direction relative to the main resting face.

15. The assembly of claim 14, wherein the protrusion is configured to extend above the main resting face and exhibit a predetermined spring rate to maintain proper contact and alignment between the uppermost cartridge within the magazine and the magazine lips.

16. A semi-automatic handgun, comprising:

a frame including a grip that has a magazine entrance;

a slide disposed on the frame for movement between a forward position and a rearward position;

a magazine received within the magazine entrance, the magazine comprising:

a hollow magazine body having an open top end including a pair of magazine lips disposed to retain cartridges within the magazine body;

a compression spring housed within the magazine body;

a follower configured for movement within the magazine body against the force of the compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein the protrusion does not extend above the main resting face when a cartridge body is simultaneously maintained in contact with the main resting face on one side and the magazine lips on an opposite side; and a handgun barrel received within the slide and linked to the frame.

17. The semi-automatic handgun of claim 16, wherein the protrusion and follower are formed of a single integral piece.

18. The semi-automatic handgun of claim 16, wherein the protrusion and follower are formed of a molded thermoplastic material.

19. The semi-automatic handgun of claim 18, wherein the molded thermoplastic material is nylon.

20. The semi-automatic handgun of claim 16, wherein the main resting face of the follower has a concave shape configured to accommodate the outside profile of a cartridge body.

21. The semi-automatic handgun of claim 16, wherein the main resting face of the follower includes a cut out area for accommodating the protrusion.

22. The semi-automatic handgun of claim 16, wherein the protrusion rests above the main resting face and generates a vertically directed force by being resiliently biased in an upward direction relative to the follower resting face.

23. The semi-automatic handgun of claim 16, wherein the protrusion extends above the main resting face to contact a cartridge loaded within the magazine body to maintain complete contact between the cartridge body and the magazine lips when the follower is tilted within the magazine body.

24. The semi-automatic handgun of claim 16, wherein the protrusion includes a projection configured to contact a cartridge, loaded within the magazine body, at a predetermined location such that a clockwise or counterclockwise moment is generated to act upon a misaligned cartridge during a handgun loading cycle.

25. The semi-automatic handgun of claim 16, wherein an underside of the protrusion includes a cut out portion that accommodates an upper portion of the compression spring such that contact between the compression spring and protrusion provides upward movement of the protrusion relative to the main resting face of the follower.

26. The semi-automatic handgun of claim 16, wherein the protrusion is joined to the main resting face by an integral hinge, such that the compression spring provides rotational movement of the protrusion about the hinge.

27. The semi-automatic handgun of claim 26, further comprising a protuberance located on the protrusion at an end opposite the integral hinge, the rotation of the protrusion about the hinge being limited by contact of the protuberance with an underside of the main resting face.

28. The semi-automatic handgun of claim 16, wherein the magazine lips include shaped upper edge portions that extend inwardly toward each other to such a distance as to slidably fit a single cartridge.

29. A magazine follower for use in a magazine body having magazine lips, comprising:

the follower configured for movement within the magazine body against the force of a compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein the protrusion does not extend above the main resting face when a cartridge body is simultaneously maintained in contact with the main resting face on one side and the magazine lips on an opposite side.

30. The follower of claim 29, wherein the main resting face of the follower has a concave shape configured to accommodate the outside profile of a cartridge body.

31. The follower of claim 30, wherein the main resting face of the follower includes a cut out area for accommodating the protrusion.

32. The follower of claim 29, wherein the protrusion and follower are formed of a single integral piece.

33. The follower of claim 32, wherein the protrusion and follower are formed of a molded thermoplastic material.

34. The follower of claim 33, wherein the molded thermoplastic material is nylon.

35. The follower of claim 29, wherein an underside of the protrusion includes a cut out portion configured to receive a portion of a compression spring such that contact between the compression spring and protrusion provides upward movement of the protrusion relative to the main resting face of the follower.

36. The follower of claim 29, wherein the protrusion is joined to the main resting face by an integral hinge, such that a vertically directed force against an underside of the protrusion provides rotational movement of the protrusion about the hinge.

37. The follower of claim 36, further comprising a protuberance located on the protrusion at an end opposite the integral hinge, the rotation of the protrusion about the hinge being limited by contact of the protuberance with an underside of the main resting face.

38. The follower of claim 37, wherein the protrusion includes a projection configured to contact a cartridge loaded within a magazine body, at a predetermined location during upward rotation of the protrusion such that a clockwise or counterclockwise moment is generated to act upon a misaligned cartridge during a handgun loading cycle.

39. The follower of claim 29, further comprising spring tabs that extend from a rear position of the follower in order to maintain a proper position of the follower during translation within a magazine body.

40. The follower of claim 29, wherein the protrusion rests above the main resting face and generates a vertically directed force by being resiliently biased in an upward direction relative to the main resting face.

41. The follower of claim 40, wherein the protrusion is configured to extend above the main resting face and exhibit a predetermined spring rate to maintain proper contact and alignment between the uppermost cartridge within the magazine and the magazine lips.

42. A magazine assembly comprising:

a magazine body configured to be received within a recess in a handgun, the magazine body having a bottom end, a front wall, a back wall, left and right side walls, and an open top end including a pair of magazine lips disposed to retain cartridges within the magazine body;

a compression spring housed within the magazine body and disposed against the bottom end of the magazine body;

a follower configured for movement within the magazine body against the force of the compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein an underside of the protrusion includes a cut out portion that accommodates an upper portion of the compression spring such that contact between the compression spring and protrusion provides upward movement of the protrusion relative to the main resting face of the follower.

43. The assembly of claim 42, wherein the protrusion and follower are formed of a single integral piece.

44. The assembly of claim 42, wherein the protrusion is joined to the main resting face by an integral hinge, such that the compression spring provides rotational movement of the protrusion about the hinge.

45. A semi-automatic handgun, comprising:

a frame including a grip that has a magazine entrance;

a slide disposed on the frame for movement between a forward position and a rearward position;

a magazine received within the magazine entrance, the magazine comprising:

a hollow magazine body having an open top end including a pair of magazine lips disposed to retain cartridges within the magazine body;

a compression spring housed within the magazine body;

a follower configured for movement within the magazine body against the force of the compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein an underside of the protrusion includes a cut out portion that accommodates an upper portion of the compression spring such that contact between the compression spring and protrusion provides upward movement of the protrusion relative to the main resting face of the follower; and a handgun barrel received within the slide and linked to the frame.

46. The semi-automatic handgun of claim 45, wherein the protrusion and follower are formed of a single integral piece.

47. The semi-automatic handgun of claim 45, wherein the main resting face of the follower includes a cut out area for accommodating the protrusion.

48. A magazine follower for use in a magazine body having magazine lips, comprising:

the follower configured for movement within the magazine body against the force of a compression spring, the follower having a main resting face configured to contact a cartridge body when a cartridge is at a feed angle, and a resilient protrusion extending therefrom, the protrusion being movable relative to the main resting face, the protrusion being configured to impart a force against the cartridge when the cartridge is at an angle other than the feed angle and rotate the cartridge toward the feed angle, wherein an underside of the protrusion includes a cut out portion configured to receive a portion of a compression spring such that contact between the compression spring and protrusion provides upward movement of the protrusion relative to the main resting face of the follower.

49. The follower of claim 48, wherein the main resting face of the follower has a concave shape configured to accommodate the outside profile of a cartridge body.

50. The follower of claim 48, wherein the protrusion and follower are formed of a single integral piece.

* * * * *

UNITED STATES PATENT AND TRADEMARK OFFICE

CERTIFICATE OF CORRECTION

PATENT NO. : 7,530,191 B2
APPLICATION NO. : 11/109934
DATED : May 12, 2009
INVENTOR(S) : Atilla Szabo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 743 days.

Signed and Sealed this

Seventh Day of September, 2010

David J. Kappos

David J. Kappos
*Director of the United States Patent and Trademark Office*